US007971278B2

(12) United States Patent
Klamerus, Jr.

(10) Patent No.: US 7,971,278 B2
(45) Date of Patent: Jul. 5, 2011

(54) HAT COVER AND FRAME

(76) Inventor: Richard Klamerus, Jr., El Mirage, AZ (US)

( * ) Notice: Subject to any disclaimer, the term of this patent is extended or adjusted under 35 U.S.C. 154(b) by 94 days.

(21) Appl. No.: 12/457,630

(22) Filed: Jun. 17, 2009

(65) Prior Publication Data

US 2010/0031425 A1 Feb. 11, 2010

Related U.S. Application Data

(60) Provisional application No. 61/136,039, filed on Aug. 8, 2008.

(51) Int. Cl.
*A41B 1/18* (2006.01)

(52) U.S. Cl. ..... 2/209.13; 2/172; 2/181.4; 2/181; 2/175.6; 2/209.7; 2/203

(58) Field of Classification Search ..... 2/209.13, 2/4, 410, 172, 173, 184.5, 202, 203, 206, 2/207, 175.6, 175.7, 181, 181.4, 209.3, 209.4, 2/209.5, 209.7, 171.1
See application file for complete search history.

(56) References Cited

U.S. PATENT DOCUMENTS

| | | | | |
|---|---|---|---|---|
| 1,706,205 | A * | 3/1929 | Alonzo | 2/172 |
| 3,166,766 | A * | 1/1965 | Banello, Jr. | 2/175.6 |
| 5,025,504 | A * | 6/1991 | Benston et al. | 2/181.4 |
| 5,153,943 | A * | 10/1992 | Clement | 2/418 |
| 5,197,292 | A | 3/1993 | McPherson | |
| 5,553,326 | A * | 9/1996 | Moore | 2/181 |
| 5,613,248 | A * | 3/1997 | Young | 2/181.4 |
| 5,694,647 | A * | 12/1997 | Crickmore | 2/172 |
| 5,694,648 | A * | 12/1997 | Nucifora | 2/172 |
| 5,826,279 | A * | 10/1998 | Tencer | 2/181 |
| 6,260,204 | B1 | 7/2001 | Morrissey | |
| D474,327 | S | 5/2003 | Giesen et al. | |
| 6,802,083 | B2 | 10/2004 | Van | |
| 2008/0066214 | A1 | 3/2008 | O'Hare | |
| 2009/0205107 | A1 * | 8/2009 | Coba | 2/171.2 |

* cited by examiner

*Primary Examiner* — Khoa D Huynh
*Assistant Examiner* — Alissa J Tompkins
(74) *Attorney, Agent, or Firm* — Richard C. Litman

(57) ABSTRACT

A hat cover protects the face and neck of a wearer. The cover can be designed to fit almost any type or style of hat. The cover is adapted to slip over the outer area of the hat and to be easily attached and detached. The cover includes rear and side wing portions that drape below the rim of the hat to cover the neck and face of the wearer. The hat may be provided with a pouch for containing a cooling medium (ice), if desired. The hat cover may include frames specially designed for use with the cover if no hat is worn.

2 Claims, 3 Drawing Sheets

HAT COVER AND FRAME

CROSS-REFERENCE TO RELATED APPLICATION

This application claims the benefit of U.S. Provisional Patent Application Ser. No. 61/136,039, filed Aug. 8, 2008.

BACKGROUND OF THE INVENTION

1. Field of the Invention

The present invention generally relates to wearing apparel, and particularly to a cover that is attached to a hat and extends the protection afforded by the hat.

2. Description of the Related Art

Daytime outdoor activity, whether required or opted for, is beneficial because exposure to sunlight increases the intake of vitamin D, which is much needed to ensure health. Unfortunately, exposure to sunlight also has a down side. Excessive exposure to harmful sunrays can cause painful sunburn and thereby increase the possibility for skin cancer. While conventional clothing covers most of the torso, the face and neck normally remain exposed even when a hat is worn. While the application of a suitable sunscreen lotion is advised, other means of protection should also be available to people who are frequently outdoors during the daylight hours.

Hikers, landscape workers, playing children and athletes are among the many people who would benefit from a covering that could be attached to a hat, the covering extending the protection afforded by a hat to protect the above-mentioned exposed body parts from the direct rays of the sun. Thus a hat cover solving the aforementioned problems is desired.

SUMMARY OF THE INVENTION

The hat cover can be adapted to fit almost any type or style of hat. The cover is adapted to slip over the outer area of the hat and to be easily attached and detached. Although hook and loop fasteners are preferred, the attachment can be accomplished with any suitable, conventional, fastening devices (clips, buttons, zippers, etc.). The cover includes rear and side wing portions (that extend to the front) and drape below the rim of the hat to cover the neck and face of the wearer. The cover may be provided with a pouch for containing a cooling medium (ice), if desired. Various embodiments of the hat cover may include frames especially designed for use as a cover if no hat is worn. The cover can be fabricated in different in various colors or color combinations to satisfy different aesthetic tastes.

Accordingly, the invention presents a cover that is utilized to minimize a wearer's exposure to direct sunlight on the face and neck. The cover is adapted to be easily attached and detached from conventional headwear. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
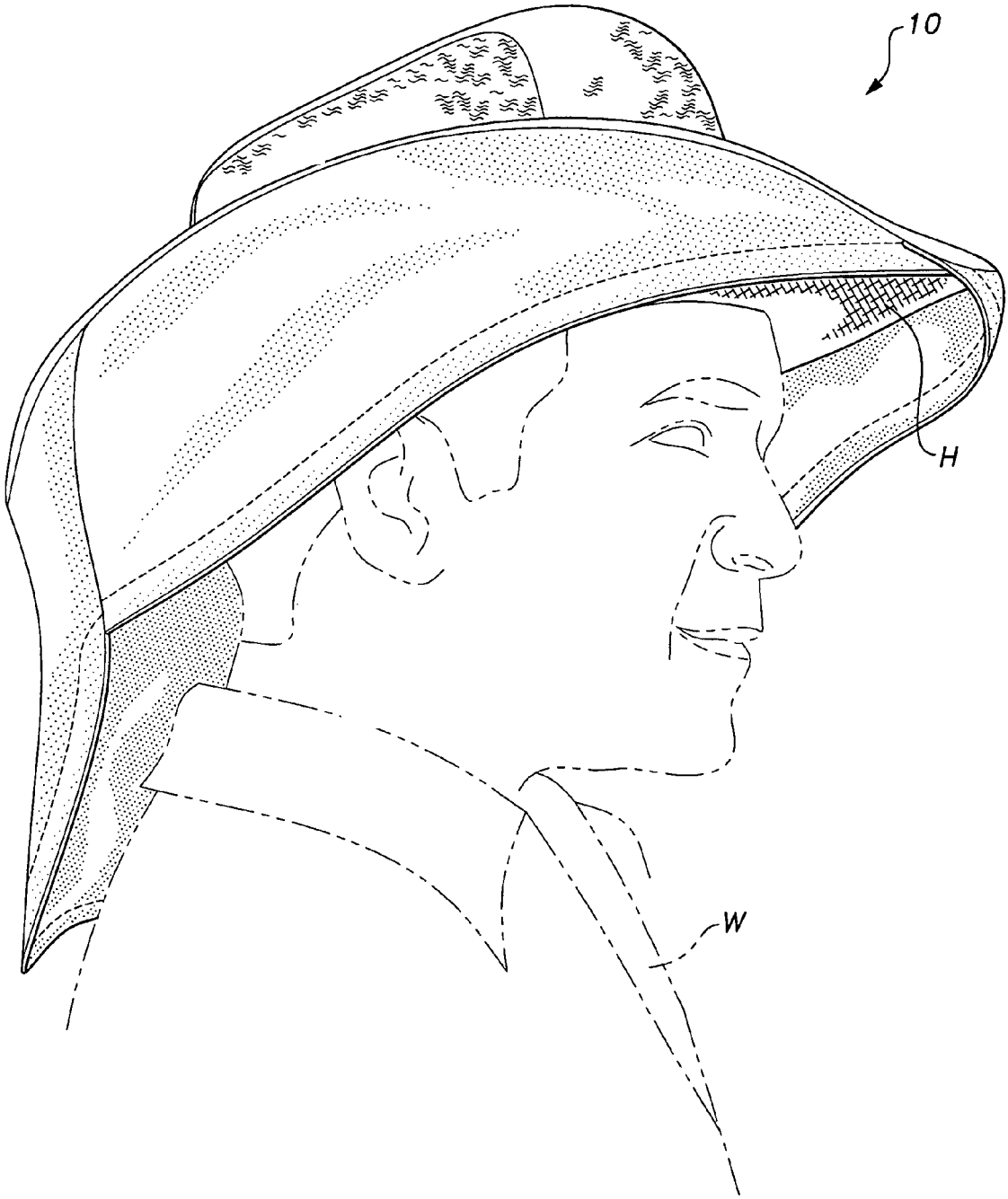
FIG. 1 is an environmental, perspective view of a hat cover according to the present invention.
Figure 2:
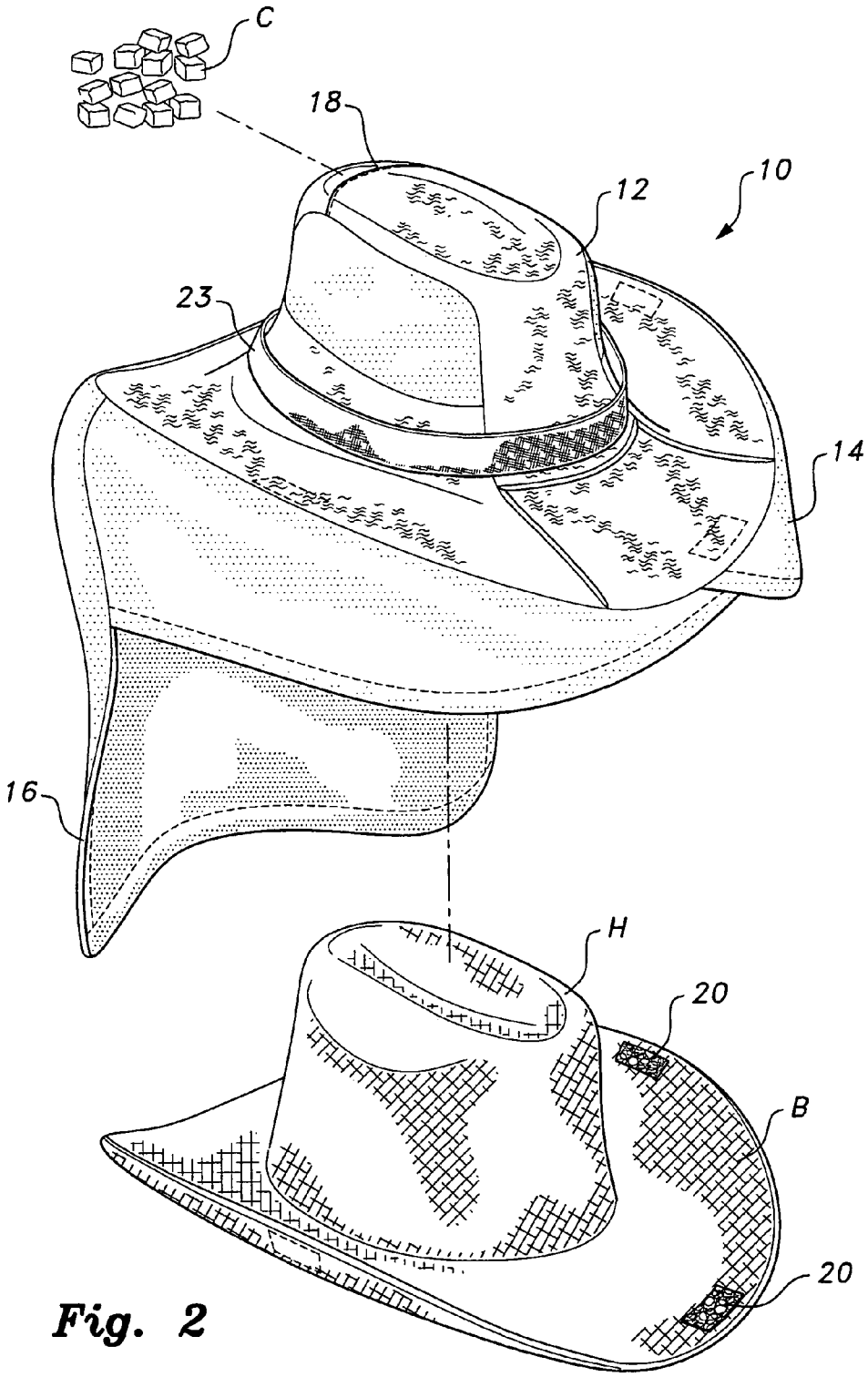
FIG. 2 is an exploded perspective view showing a hat cover according to the present invention in combination with a hat.

Attention is first directed to FIGS. 1 and 2, wherein the hat cover is generally indicated at 10. Cover 10 is generally configured in the shape of the hat H that it will completely cover. As illustrated, cover 10 is generally configured to conform to a hat H having a brim B. It is noted, however, that the cover 10 can be configured to conform to hats of any configuration (baseball, helmet, beret, hardhat, etc.). Cover 10 comprises a shell 12 having side wings 14 and a rear wing 16 depending therefrom. Side wings 14 and rear wing 16 provide protection for the wearer's W face and neck. The shell and wings 14, 16 are fabricated from a soft, flexible, washable, porous material. The material can be water-resistant if desired. A sealable pouch 18 is optionally provided in the crown of shell 12. Pouch 18 is adapted to house a cooling medium, such as ice C. The pouch may or may not be liquid impervious. Conventional hook and loop fasteners 20 are employed to attach shell 12 to hat H. A washable elastic shell band 23 is removably mounted around the shell 12 to further secure the shell to hat H.

Figure 3:
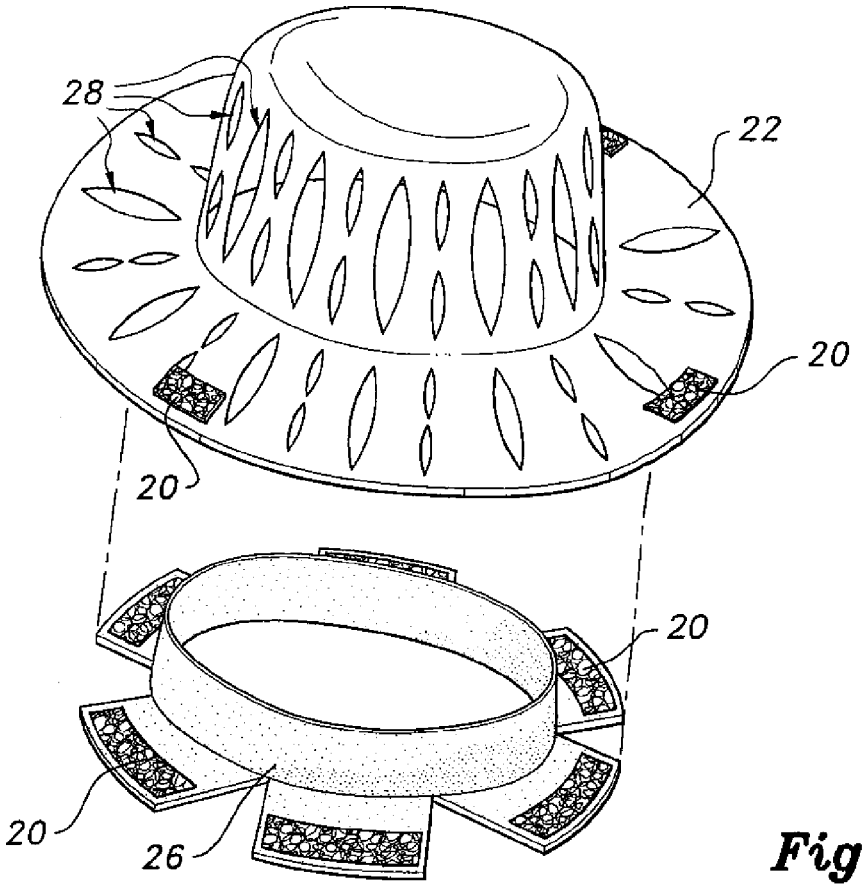
FIG. 3 is a first embodiment of a brim for use with a hat cover according to the present invention.
Figure 4:
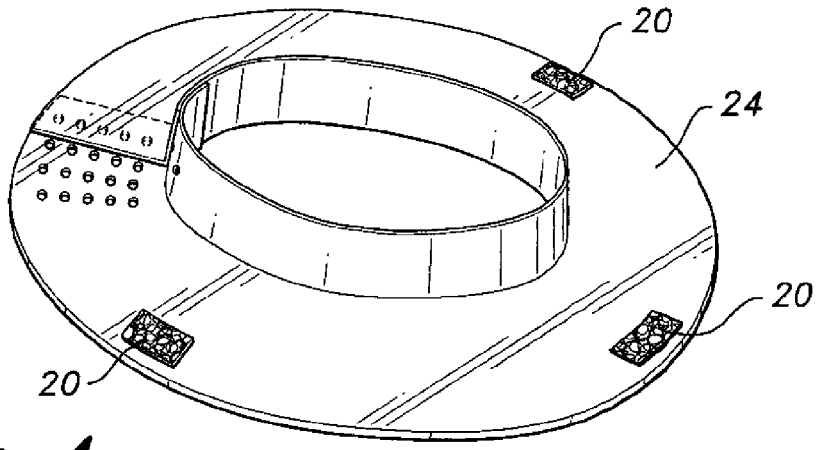
FIG. 4 is a second embodiment of a brim for use with a hat cover according to the present invention.

In lieu of a hat, a brim or frame may be employed to support cover 10 thereon. The frame may be configured in many shapes and is not limited to the shapes of frames 22 and 24 shown in FIGS. 3 and 4. Frames 22 and 24 are fabricated from any suitable, water resistant, washable material. The frames offer little or no protection from the sun or other elements. As seen in FIG. 3, a plurality of holes 28 are located throughout the frame in order to cool the wearer or to assist the cooling medium located in pouch 18 when the cover 10 is used. A soft headband 26 can optionally be incorporated to absorb perspiration. Headband 26 can be fabricated from any stretchable, washable material. Although hook and loop fasteners 20 are preferred, it is recognized that other fasteners may be employed if deemed suitable. The removable headband can also be employed with a hat. As with cover 10, headband 26 will be fabricated in different colors or combinations thereof. As noted above, a cover 10 will be utilized with the frames 22, 24 to afford protection for the wearer.

It is to be understood that the present invention is not limited to the embodiments described above, but encompasses any and all embodiments within the scope of the following claims.

I claim:

1. A protective cover for a wearer's head and neck, comprising:

a head covering having an outer surface and an inner surface, wherein said head covering is a frame made of water resistant, washable material, the frame including a plurality of holes throughout the frame;

a shell covering the outer surfaces of said head covering;

first and second protective side wing members depending from the shell;

a rear protective wing member depending from the shell;

a plurality of fasteners removably attaching the shell to the head covering;

a headband removably attached to the inner surface of the head covering;

an elastic band mounted around the shell thereby securing the shell to the wearer; and a sealable pouch disposed in the shell and being operatively associated with the frame whereby a cooling medium located in the pouch can cool the wearer through the plurality of holes located in the frame.

2. The protective cover for a wearer's head and neck according to claim 1, wherein said fasteners comprise hook and loop fasteners.

* * * * *